US005715844A

United States Patent [19]

Young et al.

[11] Patent Number: 5,715,844

[45] Date of Patent: *Feb. 10, 1998

[54] TOBACCO RECONSTITUTION PROCESS

[75] Inventors: Harvey James Young, Advance; Thomas Wayne Brown, Clemmons; Sara Williams Devine, Pfafftown; Thomas Albert Perfetti, Winston-Salem, all of N.C.

[73] Assignee: R. J. Reynolds Tobacco Company, Winston-Salem, N.C.

[ * ] Notice: The term of this patent shall not extend beyond the expiration date of Pat. No. 5,533,530.

[21] Appl. No.: 576,677

[22] Filed: Dec. 21, 1995

Related U.S. Application Data

[63] Continuation of Ser. No. 299,870, Sep. 1, 1994, Pat. No. 5,533,530.

[51] Int. Cl.[6] ..... A24B 3/14

[52] U.S. Cl. ..... 131/374; 131/370; 131/356; 131/357

[58] Field of Search ..... 131/290, 297, 131/353, 356, 357, 359, 369, 370–375

[56] References Cited

U.S. PATENT DOCUMENTS

| | | | |
|---|---|---|---|
| 2,708,175 | 5/1955 | Samfield et al. | 131/17 |
| 2,845,933 | 8/1958 | Samfield et al. . | |
| 3,353,541 | 11/1967 | Hind et al. . | |
| 3,385,303 | 5/1968 | Hind et al. . | |
| 3,386,449 | 6/1968 | Hind et al. . | |
| 3,386,450 | 6/1968 | Seligman et al. . | |
| 3,398,754 | 8/1968 | Tughan . | |
| 3,409,026 | 11/1968 | Hind et al. . | |
| 3,411,514 | 11/1968 | Hind et al. . | |
| 3,411,515 | 11/1968 | Hind et al. . | |
| 3,420,241 | 1/1969 | Hind et al. . | |
| 3,428,053 | 2/1969 | Schoembaum et al. . | |
| 3,435,829 | 4/1969 | Hind et al. . | |
| 3,464,422 | 9/1969 | Light et al. . | |
| 3,480,018 | 11/1969 | Fairchild . | |
| 3,483,874 | 12/1969 | Hind . | |
| 3,499,454 | 3/1970 | Hind . | |
| 3,540,455 | 11/1970 | Flore et al. . | |
| 3,540,456 | 11/1970 | McGhumphy et al. . | |
| 3,616,801 | 11/1971 | Hind . | |
| 3,746,012 | 7/1973 | Deszyck . | |
| 3,760,815 | 9/1973 | Deszyck . | |
| 3,847,164 | 11/1974 | Mattina et al. . | |
| 4,182,349 | 1/1980 | Selke . | |
| 4,270,552 | 6/1981 | Jenkins et al. . | |
| 4,333,484 | 6/1982 | Keritsis . | |

(List continued on next page.)

FOREIGN PATENT DOCUMENTS

| | | |
|---|---|---|
| 844348 | 6/1970 | Canada . |
| 0535834A1 | 4/1993 | European Pat. Off. . |

OTHER PUBLICATIONS

Siberstein, Flavouring Reconstituted Tobacco, *TJI,* 1:26–29 (1985).

Voges, Sheet Tobacco, *Tobacco Encyclopedia,* pp. 389–390 (1984).

*Primary Examiner*—Vincent Millin

[57] ABSTRACT

The process of the present invention involves extracting components from a tobacco material or other plant material using a solvent having an aqueous character to provide separately an aqueous tobacco extract and a water insoluble tobacco portion. The insoluble tobacco portion is refined and a slurry is produced. The slurry is formed into a predetermined shape, e.g., a formed web. The formed web can be pressed to reduce the moisture content. The tobacco material preferably has a moisture content of at least about 50 percent by weight. The material is contacted with an aqueous mixture of an aerosol precursor material. The ratio of liquid having an aqueous character to aerosol precursor material is typically from about 25 to 75 percent by weight. Immediately after the introduction of the aerosol precursor material, the web is dried at a preselected temperature so that the aerosol precursor material is dispersed evenly throughout the web.

5 Claims, 1 Drawing Sheet

U.S. PATENT DOCUMENTS 4,337,783 7/1982 Hooper et al. .
4,341,228 7/1982 Keritsis et al. .
4,421,126 12/1983 Gellatly .
4,611,608 9/1986 Vos et al. .
4,674,519 6/1987 Keritsis et al. .
4,706,692 11/1987 Gellatly .
4,714,082 12/1987 Banerjee et al. .
4,821,749 4/1989 Toft et al. .
4,827,950 5/1989 Banerjee et al. .
4,858,630 8/1989 Banerjee et al. .
4,861,427 8/1989 Johnson et al. .
4,874,000 10/1989 Tamol et al. .
4,880,018 11/1989 Graves, Jr. et al. .
4,962,774 10/1990 Thomasson et al. .
4,972,854 11/1990 Kiernan et al. .
4,981,522 1/1991 Nichols et al. .
4,987,906 1/1991 Young et al. ..... 131/297
5,025,814 6/1991 Raker .
5,099,864 3/1992 Young et al. .
5,101,839 4/1992 Jakob et al. .
5,143,097 9/1992 Sohn et al. ..... 131/356
5,159,942 11/1992 Brinkley et al. .
5,203,354 4/1993 Hickle .
5,240,016 8/1993 Nichols et al. .
5,325,877 7/1994 Young et al. ..... 131/290
5,327,917 7/1994 Lekwauwa et al. .
5,533,530 7/1996 Young et al. ..... 131/370

TOBACCO RECONSTITUTION PROCESS

This application is a Continuation of application Ser. No. 08/299,870, filed Sep. 1, 1994 now U.S. Pat. No. 5,533,530.

BACKGROUND OF THE INVENTION

The present invention relates to a process for providing a reconstituted tobacco material, and more particularly to a reconstituted tobacco material which can be used as a substrate material especially useful in making smoking articles.

Cigarettes and other smoking articles have a substantially cylindrical rod shaped structure and includes a charge of tobacco material surrounded by a wrapper, such as paper, thereby forming a so-called "tobacco rod." It has become desirable to manufacture a cigarette having a cylindrical filter aligned in an end-to-end relationship with the tobacco rod. Typically, a filter includes cellulose acetate circumscribed by plug wrap, and is attached to the tobacco rod using a circumscribing tipping material. See Baker, *Prog. Ener. Combust. Sci.*, 7:135–153 (1981). Typical cigarettes include blends of various tobaccos, such as the flue-cured, Burley, Md., and Oriental tobaccos. Cigarette blends also can include certain amounts of processed and reconstituted tobacco materials. Reconstituted tobacco materials often are manufactured from tobacco stems, dust, and scrap using papermaking processes. See, for example, U.S. Pat. No. 4,962,774 to Thomasson et al.; U.S. Pat. No. 4,987,906 to Young et al.; and U.S. Pat. No. 4,421,126 to Gellatly.

Other cigarette-like smoking articles have also been proposed. Many such cigarette-like smoking articles are based on the generation of an aerosol or vapor. Smoking articles of this type, as well as materials, methods and/or apparatus useful therein and/or for preparing such cigarettes are described, for example, in the following U.S. Pat. No. 4,714,082 to Banerjee et al., U.S. Pat. No. 4,732,168 to Resce; U.S. Pat. No. 4,756,318 to Clearman et al.; U.S. Pat. No. 4,782,644 to Haarer et al.; U.S. Pat. No. 4,793,365 to Sensabaugh et al.; U.S. Pat. No. 4,802,568 to Haarer et al.; U.S. Pat. No. 4,807,809 to Pryor et al.; U.S. Pat. No. 4,827,950 to Banerjee et al.; U.S. Pat. No. 4,858,630 to Banerjee et al.; U.S. Pat. No. 4,870,748 to Hensgen et al.; U.S. Pat. No. 4,881,556 to Clearman et al.; U.S. Pat. No. 4,893,637 to Hancock et al.; U.S. Pat. No. 4,893,639 to White; U.S. Pat. No. 4,903,714 to Barnes et al.; U.S. Pat. No. 4,917,128 to Clearman et al.; U.S. Pat. No. 4,928,714 to Shannon; U.S. Pat. No. 4,938,238 to Barnes et al.; U.S. Pat. No. 4,989,619 to Clearman et al.; U.S. Pat. No. 5,027,836 to Shannon et al.; U.S. Pat. No. 5,027,839 to Clearman et al.; U.S. Pat. No. 5,042,509 to Banerjee et al.; U.S. Pat. No. 5,052,413 to Baker et al.; U.S. Pat. No. 5,060,666 to Clearman et al.; U.S. Pat. No. 5,065,776 to Lawson et al.; U.S. Pat. No. 5,067,499 to Banerjee et al.; U.S. Pat. No. 5,076,292 to Baker et al.; U.S. Pat. No. 5,099,861 to Clearman et al.; U.S. Pat. No. 5,101,839 to Jakob et al.; U.S. Pat. No. 5,105,831 to Banerjee et al.; U.S. Pat. No. 5,105,837 to Barnes et al.; and U.S. Pat. No. 5,119,837 to Banerjee et al.; U.S. Pat. No. 5,183,062 to Clearman et al.; and U.S. Pat. No. 5,203,355 to Clearman, et al., as well as in the monograph entitled *Chemical and Biological Studies of New Cigarette Prototypes That Heat Instead of Burn Tobacco*, R. J. Reynolds Tobacco Company, 1988 (hereinafter "RJR Monograph"). These cigarettes are capable of providing the smoker with the pleasure of smoking (e.g., smoking taste, feel, satisfaction, and the like). Such smoking articles typically provide low yields of visible sidestream smoke as well as low yields of FTC tar when smoked.

The smoking articles described in the aforesaid patents and/or publications generally employ a combustible fuel element for heat generation and an aerosol generating means, positioned physically separate from, and typically in a heat exchange relationship with the fuel element. Many of these aerosol generating means employ a substrate or carrier for one or more aerosol precursor materials, e.g., polyhydric alcohols, such as glycerin. The aerosol precursor materials are volatilized by the heat from the burning fuel element and upon cooling form an aerosol. Normally, the fuel elements of such smoking articles are circumscribed by an insulating jacket. The carrier or substrate can be a reconstituted tobacco material.

Most of these smoking articles, however, have never achieved any commercial success. It is believed that the absence of such smoking articles from the marketplace is in part due to insufficient aerosol generation, both initially and over the life of the smoking article, along with other negative characteristics such as poor taste, off-taste due to the thermal degradation of the aerosol-former, the presence of pyrolysis products, sidestream smoke, and unsightly appearance. Moreover, the aerosol precursor material is typically applied only to the surface of the smokable material or substrate. This surface treatment, however, results in a tacky surface which often slows down processing.

It would be desirable to provide a reconstituted tobacco material useful in cigarettes and other smoking articles, and more particularly a reconstituted tobacco material incorporating a high level, by weight, of an aerosol precursor material therein.

SUMMARY OF THE INVENTION

The present invention provides a process which facilitates the introduction of large quantities of an aerosol precursor material into a reconstituted tobacco material manufactured in a papermaking process. As a consequence, the tobacco processor or cigarette manufacturer can provide a commercially acceptable reconstituted tobacco material having certain desirable attributes for use in various smoking articles.

In conventional papermaking processes, it is difficult to provide a reconstituted tobacco material or other smokable plant material useful as a substrate because of the limited amount of aerosol precursor material (e.g.., glycerin) which can be introduced into the material during the traditional papermaking processes which have been used to produce reconstituted tobacco material. Therefore, it is desirable to increase the amount of aerosol precursor material which can be introduced into reconstituted tobacco materials in papermaking processes. The amount of aerosol precursor material or the method of applying it should not, however, result in the reconstituted tobacco material having a tacky surface that can significantly slow down processing.

The process of the present invention involves extracting components from a tobacco material or other plant material using a solvent having an aqueous character to provide separately an aqueous tobacco extract and a water insoluble tobacco portion. The insoluble tobacco portion is refined and a slurry is produced. The slurry is formed into a predetermined shape (e.g., a sheet or web). The formed web can be pressed to reduce the moisture content. The tobacco material preferably has a moisture content of at least about 50 percent by weight, preferably at least about 60 percent by weight, and most preferably at least about 70 percent by weight. The material is contacted with an aqueous mixture of an aerosol precursor material, for example, glycerin and a liquid having an aqueous character (e.g., water). The ratio of liquid having an aqueous character to aerosol precursor material is typically from about 25 to 75 percent by weight. Other additives can be introduced into the solution at this point, such as ammonia, inorganic and/or organic acids, salts of such acids, or a tobacco extract. A phosphate salt (i.e., a pectin release agent) soluble in the liquid having the aqueous character can also be added at this point to release the pectins in the tobacco material if desired.

In an embodiment, the aerosol precursor material can be heated from about 40° C. to 200° C. In another embodiment, the formed web can be heated to a temperature of from about 40° C. to 200° C. It is believed that such heating facilitates penetration of the aerosol precursor material into the formed web.

Immediately after the introduction of the aerosol precursor material, the web is dried at a preselected temperature so that the aerosol precursor material is dispersed evenly throughout the web. Additional materials may be introduced onto the web, such as binders, cross-linking agents, burn retardants and additional tobacco extracts and flavors at various additional locations throughout the process, for example, immediately after the initial drying step, prior to the final web drying or just prior to exiting the dryer. Typically, the final drying stage is carried out by a hot air or convective heat dryer which has a number of passes through the heating or drying zone. The most volatile materials to be added to the web may be applied prior to the final pass through the drying zone.

The resulting reconstituted tobacco material which is manufactured according to the process of the present invention contains high levels of aerosol precursor materials (i.e., an aerosol precursor material content of greater than about 35 percent by weight) incorporated therein and, therefore, can be used as smokable material or substrate materials like those in various types of cigarettes described, for example, in U.S. Pat. No. 5,101,839 to Jakob et al.; European Patent Application No. 545,186, and U.S. patent application Ser. No. 08/040,229 filed Mar. 30, 1993.

DETAILED DESCRIPTION OF A PREFERRED EMBODIMENT

Figure 1:
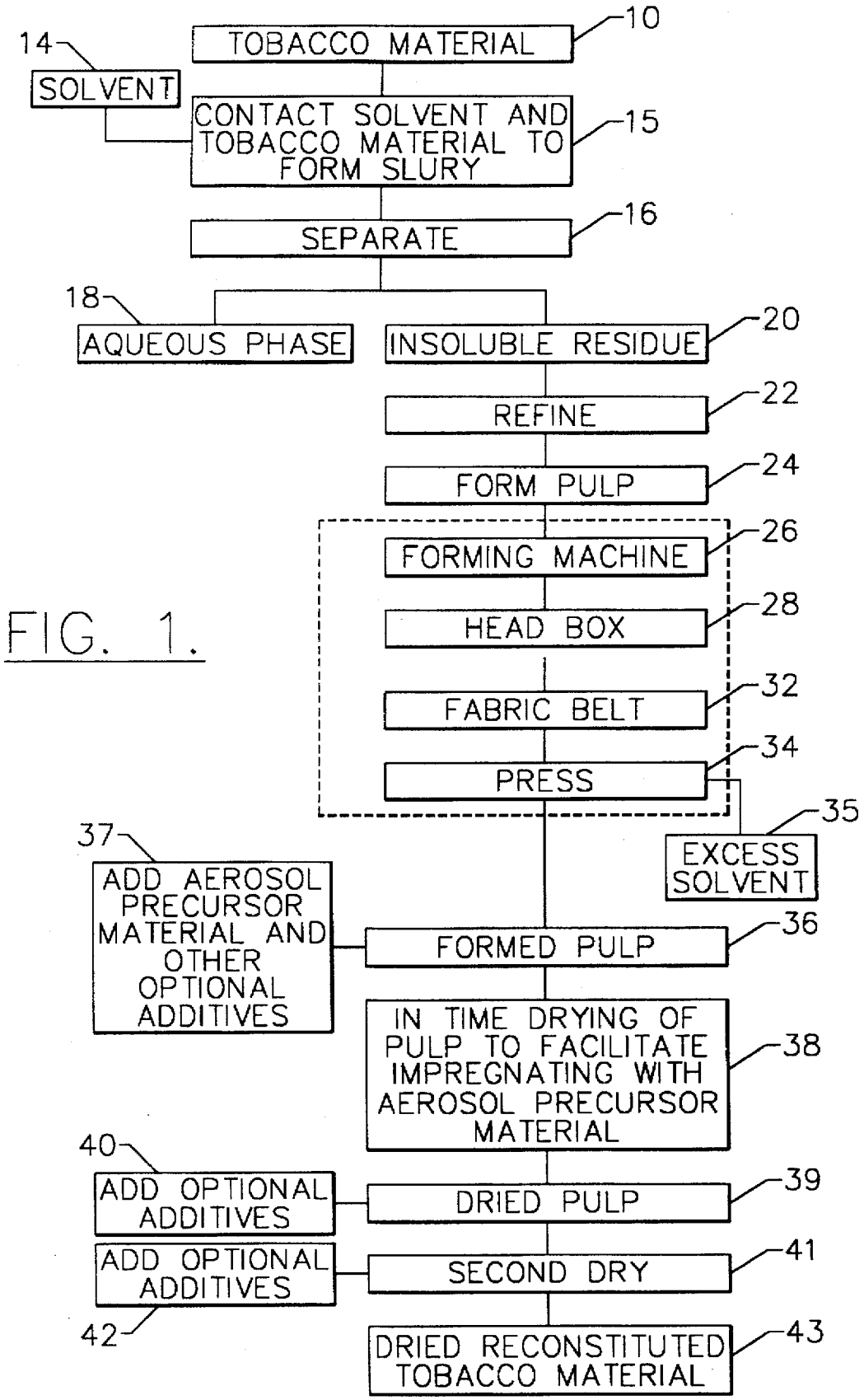
FIG. 1 is schematic diagram of steps representative of an embodiment of the present invention.

Referring to FIG. 1, the tobacco material 10 or other smokable plant material is contacted with a solvent 14 having an aqueous character (e.g., tap water) under conditions such that solvent soluble components of the tobacco material or other plant material are extracted by the solvent. The mixture 15, which is an aqueous tobacco material slurry, is subjected to separation conditions 16 to provide tobacco material extract components in an aqueous phase 18 (e.g., water and extract) and a solvent insoluble tobacco material residue 20. The manner of separation of the liquid extract from the insoluble residue can vary and will be within the skill of one in the art.

The water insoluble residue 20 (i.e., extracted tobacco material) can be refined 22 using papermaking type refiners such as disc refiners, conical refiners, or the like. The residue is subjected to a size reduction step and thereby is formed into pulp 24 for use in the subsequent manufacture of a reconstituted tobacco material product. The refined pulp 24 is transferred to a forming machine 26 consisting of a headbox 28, a continuous fabric or wire mesh belt 32, and a series of presses 34. Such a forming machine is common in the papermaking industry. The selection and operation of a conventional forming machine will be apparent to the skilled artisan. The pulp is laid onto the fabric or wire mesh belt 32 (e.g., after being laid onto a forming cylinder) and is thereby formed into a sheet-like shape. Preferably, the pulp material laid on the belt is sufficient to provide a sheet having a basis weight between 30 to 125 g/m$^2$, preferably between 45 and 100 g/m$^2$, most preferably between 70 and 90 g/m$^2$. Excess solvent 35 is removed from the pulp using the series of presses 34 after initial solvent removal on the fabric or wire belt to produce a formed pulp 36. The formed pulp 36 is processed to a moisture content of at least about 50 percent, and often between about 60 to 85 percent, and preferably between about 68 to 79 percent.

If desired, the excess solvent removed or separated during refining and forming into a pulp which contains tobacco particles can be collected, concentrated and the tobacco particles can be separated and applied to the preformed pulp. (See, for example, U.S. patent application Ser. No. 08/096,768 filed Jul. 23, 1993.)

The formed moist pulp 36 is then contacted with an aerosol precursor material 37, for example, glycerin, propylene glycol, triethylene glycol, and the like. Although the aerosol precursor material can be applied alone, typically, the aerosol precursor material is applied in an aqueous (water) mixture with a ratio of water to aerosol precursor material of about 15 to 85, and preferably about 25 to about 75. Preferably, the amount of aerosol precursor ranges from about 30 to 90 percent, preferably from about 35 to 70 percent, and most preferably from 45 to 60 percent based on the dry weight of the final or finished tobacco material. The aerosol precursor is normally sprayed onto the formed pulp 36. Other means of applying the aerosol precursor will be apparent to those skilled in the art.

In addition, the optional additional materials may be added to the formed pulp with the water/aerosol precursor mixture or as separate applications. For example, the insoluble tobacco portion may be subjected to conditions sufficient to release tobacco pectins, for example, a pectin release agent can be applied to the formed web. A preferred pectin release agent is diammonium hydrogen orthophosphate. The pectin release agent is normally applied as part of the aqueous solution of the aerosol precursor material and the solution is applied to the insoluble tobacco portion, preferably after the forming into the predetermined shape and removal of excess solvent. The pectin release agent is normally applied to the formed pulp during papermaking process using techniques such as spraying, size pressing, wicking, and the like. Typically, enough aqueous solution, including diammonium hydrogen orthophosphate as a pectin release agent is applied to the pulp to provide about 0.5 percent to about 10 percent addition of pectin release agent to the pulp, based on the dry weight of the tobacco sheet produced.

Other materials such as tobacco extracts, ammonia and burn retardant such as calcium chloride, phosphoric acid and sodium chloride may be included in the water/aerosol precursor water mixture and applied to the formed pulp at this point in the process.

In order to facilitate driving the aerosol precursor or aerosol precursor mixtures into the formed web, the web can be subjected to heat. For example, heated air may be passed over the formed web. As an alternative, the aerosol precursor material itself can be heated to a temperature of from about 40° C. to 200° C. Moreover, these two techniques can be combined, particularly if it is desirable to reduce the amount of heat air applied to the web. Other techniques, for facilitating driving the aerosol precursor mixture into the web will be within the skill of one in the art.

After application of the desired materials, the formed pulp is subjected to an initial drying step 38. The initial drying step assists in driving the aerosol precursor into the formed sheet so that it is uniformly dispersed throughout the sheet. The initial drying step permits the sheet to absorb and hold larger amounts of aerosol precursor material than are normally absorbed when the initial drying step is not used. The formed pulp is subjected to a drying heat to elevate the pulp temperature to between about 50° C. to 110° C., preferably 70° C. to about 85° C. on a dryer such as a Yankee or convection dryer. The moisture content of the initially dried sheet is preferably about 60 to 85 percent, most preferably about 68 to 70 percent (based on using a Yankee dryer).

After or during the initial drying step, the formed pulp 39 may optionally be subjected to the application of additional materials 40, such as binders, cross-linking agents, burn retardants and/or tobacco extract. Binders such as alginates, starches, locus bean gum, pectin and the like, may be added. Preferably, an alginate may be applied by spraying a solution of the binder on the sheet. The amount of binder material can vary but is preferably between about 0.25 percent to 10 percent and more preferably about 2.0 percent to 4.0 percent. If applied, the cross-linking agent is applied in sufficient quantity to react with the released pectins or added pectins from the previous step in the process. Also, liquid tobacco extract can be sprayed onto the pulp.

The sheet 39 containing the aerosol precursor material and the optional additional materials is directed into a second or final drying step 41. Typically, a hot air, convection type dryer is used as, for example, apron dryers, tunnel dryers, and the like. Typically, the sheet makes several passes through the heating or drying zone. If desired, the optional additional materials which are added to the sheet may be applied to the sheet 39 at multiple locations during the process. For example, additional materials 42 may be applied at the mouth of the dryer or at a location just prior to the last pass of the sheet material through the dryer. This is particularly true if the boiling point or vapor pressure of the material being applied would normally cause it to be driven off during the final drying process. The dried reconstituted tobacco material 43 containing the large quantity of aerosol precursor material is collected and further processed as required for use in cigarettes as substrate material or as burnable filler material.

The tobacco and other smokable materials used in the process of the present invention can vary. The tobacco materials which are reconstituted according to the present invention are of a form that, under extraction conditions, a portion thereof is soluble in (i.e., extracted by) the extraction solvent; and a portion thereof is insoluble in (i.e., not extracted by) the extraction solvent. The insoluble portion includes polymeric materials, such as cellulosics, pectins, and the like. Examples of suitable types of tobaccos include flue-cured, Oriental, Burley and Maryland tobaccos, although other types of tobacco can be employed. The tobacco material generally has been aged, and can be in the form of laminae (e.g., strip or cut filler) and/or stem, or can be in a processed form (e.g., previously reconstituted or volume expanded). The tobacco material employed can be a waste material and/or processing by-product such as fines, dust, scrap or stem. All or part of the tobacco material can be previously cased and/or top dressed. The aforementioned materials can be processed separately, or as blends thereof.

The tobacco material is contacted with a solvent having an aqueous character. Such a solvent consists primarily of water, normally greater than 90 weight percent water, and can be essentially pure water in certain circumstances. Essentially pure water includes deionized water, distilled water and tap water. However, the solvent can include water having substances such as pH buffers or the like dissolved therein. The solvent also can be a co-solvent mixture of water and minor amounts of one or more solvents which are miscible therewith. An example of such a co-solvent mixture is a solvent consisting of 95 parts water and 5 parts ethanol.

The amount of tobacco material which is contacted with the solvent can vary. Typically, the weight of solvent relative to the tobacco material is greater than 4:1, and often times greater than 5:1. The amount of solvent relative to tobacco material depends upon factors such as the type of solvent, the temperature at which the extraction is performed, the type or form of tobacco material which is extracted, the manner in which contact of the tobacco material and solvent is conducted, and other such factors. The manner of contacting the tobacco material and solvent is not particularly critical. Representative methods for extracting tobacco materials with solvents are set forth in U.S. Pat. No. 5,005,593 to Fagg and U.S. Pat. No. 5,025,812 to Fagg et al., the disclosures of which are incorporated herein by reference.

The conditions under which the extraction is performed can vary. Typical temperatures range from about 10° C. to about 85° C. The solvent/tobacco material mixture can be agitated (e.g., stirred, shaken, or otherwise mixed) in order to increase the rate at which the extraction occurs. Typically, adequate extraction of components occurs in less than about 60 minutes, and oftentimes in less than about 30 minutes. As such, an aqueous slurry is provided.

The solvent and tobacco material extract components are separated from the insoluble residue. The manner of separation of the components of the slurry can vary; however, it is convenient to employ conventional separation means such as filtration, centrifugation, pressing, or the like. Generally, the separation of the components of the slurry is performed while the slurry is maintained at above ambient temperature. It is desirable to provide a solution of solvent and extracted components having a very low level of suspended solids, while removing the greatest amount of solvent from the insoluble residue as is possible. Typically, the separation of the components of the aqueous slurry is performed in order to provide (i) a damp pulp; and (ii) an aqueous extract having extracted tobacco materials components therein. Preferably, the damp pulp has as much extract as possible removed therefrom. The aqueous extract can be concentrated for further use, or spray dried for storage and handling reasons and later dissolved in aqueous solvent.

The pulp is formed into a sheet, or other desired shape. Normally, the pulp is an extracted tobacco material having a low water extractables content. Oftentimes, as much of the water extractables as possible is removed from the pulp such that essentially no water extractables are in contact with the pulp. The pulp normally is an extracted tobacco material having less than about 25 weight percent, often less than about 20 weight percent, and preferably less than about 15 weight percent, weight percent water extractables, on a dry weight basis. Removal of a significant amount of the extractables is desirable in order that a significant amount of water soluble alkaline earth metal ions are removed from the pulp. As such, affects of such ions during the optional alkaline earth metal cross-link destruction step are minimized or eliminated. Typically, the pulp is laid onto a fabric, screen or wire mesh belt using known papermaking techniques and equipment. Oftentimes, damp pulp is contacted with further aqueous liquid to provide a slurry of sufficiently low solids content so as to have the pulp in a form which can be readily formed as a sheet on a fabric, screen or wire mesh belt. The formed pulp then is treated to remove excess solvent therefrom by passing the pulp through a series of presses, dryers, vacuum boxes, or the like. Techniques for removing excess solvent (water) from formed pulp will be apparent to the skilled artisan.

Suitable pectin release agents are described, for example, in U.S. Pat. No. 5,159,942 to Brinkley et al.; U.S. Pat. No. 4,987,906 to Young et al.; U.S. Pat. No. 4,674,519 to Keritsis et al.; and U.S. Pat. No. 3,435,829 to Hind et al., the disclosures of which are incorporated herein by reference. The amount of pectin release agent which is contacted with the extracted tobacco material can vary, and can depend upon the particular pectin release agent. Typically, the amount of pectin release agent ranges from 0.5 to 10.0 percent, preferably from about 1 percent to about 6 percent, and most preferably about 2 percent to about 5 percent, based on dry weight of the final tobacco material to which that agent is applied.

In a papermaking process, the pectin release agent and extracted tobacco material and/or dispersed tobacco particles can be combined during refining of the pulp, as the pulp enters the headbox, when the pulp is in the headbox, as the pulp exits the headbox, as the pulp is introduced to the sheet forming region of the papermaking apparatus, in the sheet forming region of the papermaking apparatus, or in the final region of the papermaking apparatus (e.g., in the suction region of the apparatus) when the moisture content of the pulp is less than about 90 percent, based on the weight of the tobacco material and aqueous liquid. The extracted tobacco material is subjected to conditions sufficient to allow for release of the pectins with the extracted tobacco material. For certain pectin release agents, such conditions typically involve providing the aqueous liquid in contact with the pulp at pH sufficiently high so as to provide the moist pulp at a pH of about 6 to about 12, preferably about 7 to about 10. As such, the pH of the aqueous liquid in contact with the pulp can be made sufficiently high to allow release of the pectins at the time that the extracted tobacco material is contacted with the pectin release agent. Alternatively, the pH of the aqueous liquid in contact with the pulp can be made sufficient to allow for destruction of the alkaline earth metal cross-links of the pectins at the time that the extracted tobacco material is contacted with the pectin release agent, and then the pH of the aqueous liquid in contact with the pulp can be made sufficient to allow release and migration of the pectins.

Suitable pH adjusting agents include ammonium hydroxide, anhydrous ammonia, potassium hydroxide, sodium hydroxide, and the like. While the pectins are released and prior to forming, they can act as a binding agent for large quantities of aerosol formers that have been applied to the formed web.

If a pectin release agent is applied to the formed pulp, the pulp can be subjected to conditions sufficient to cause the released pectins to undergo cross-linking at a later point in the process. Preferably, the aqueous tobacco extract or other agent capable of providing alkaline earth metal ions, such as calcium ions (e.g., an aqueous solution of calcium chloride) is applied to the formed pulp. The calcium ions are those calcium ions in a water soluble form, and can be provided as a mixture of aqueous tobacco extract and water soluble calcium salt. The amount of water soluble alkaline earth metal ions contacted with the formed pulp is at least sufficient to cause the released pectins to undergo alkaline earth metal cross-linking.

An aqueous tobacco extract, as are known in the art, can be uniformly applied to the pulp in a sheet-like form using a series of spray nozzles, a series of sizing rollers, a wick applicator or other such means. However, the manner of applying the aqueous extract to the pulp is not particularly critical. The amount of extract applied to the extracted tobacco can vary; and can equal the amount of extract removed from the tobacco material during extraction, can be less than the amount of extract removed from the tobacco material during extraction, or can be more than that amount of extract removed from the tobacco material during extraction (e.g., by blending extracts).

The reconstituted tobacco material produced using the pectin releasing agent on the insoluble portion during the processing exhibits excellent wet strength properties and improved integrity in the dry form. The reconstituted tobacco material base web typically exhibits a dry basis weight of about 30 to about 125 g/m$^2$. The final or finished reconstituted sheet including the aerosol precursor mixture and additives exhibits a dry basis weight of about 160 to 235 g/m$^2$.

The following examples are provided in order to further illustrate various embodiments of the invention but should not be construed as limiting the scope thereof. Unless otherwise noted, all parts and percentages are by weight.

EXAMPLE 1

A substrate comprising a reconstituted tobacco sheet is provided using a papermaking process generally as described with reference to FIG. 1 using tobacco by-products comprising a blend of tobacco types. The blend includes about 70 parts Burley and flue cured tobacco stems and about 30 parts of tobacco laminae dust and scrap.

The tobacco is extracted at about 60° C. using about 8 parts tap water for each part tobacco material and is allowed to soak for about 20 minutes. The resulting slurry of tobacco material in water is separated from the water insoluble pulp using a press or centrifuge. The liquid extract and pulp are collected separately. The pulp, which has a very low remaining water extractables content, is provided as a slurry by adding water. The slurry has a solids content of about 1.5 to about 2.5 percent. The resulting slurry is subjected to a shredding or fiber opening by passing the slurry through a disc refiner having a plate opening of about 20 mm to about 30 mm. About 300 pounds of the slurry of tobacco material, is passed through the disc refiner for about 20 minutes, and refined in a conical refiner to a Canadian Standard Freeness of about 125 to about 175 ml. The refined slurry is diluted using recirculated forming water from the papermaking process to provide a diluted slurry having water from the papermaking process to provide a diluted slurry having a solids content of about 0.6 to about 1.0 percent.

The diluted pulp is transferred to a forming machine consisting of a headbox, a forming wire mesh belt and a series of presses, operation of which will be apparent to the skilled artisan. Water is pulled off the slurry to provide a so-called "white water". The water can be used in manufacturing the reconstituted tobacco material (e.g., it can be used in the formation of the slurry). The white water can be processed (e.g., centrifuged) to remove the dispersed tobacco material particles. The pulp is then transferred to a fabric belt as is common in the papermaking industry. The pulp is formed into a continuous sheet having dry basis weight of about 70 to about 90 g/m$^2$. A vacuum is pulled on the bottom of the fabric belt so as to provide a damp, formed pulp having a moisture content of about 70 percent and to remove excess solvent. The removed excess solvent is sometimes referred to as "felt leg water".

The formed web at 85 gm/m$^2$ (dry weight basis) and approximately 70 percent moisture is then contacted, while on the Yankee, with a solution of 103.5 parts glycerin, 13.5 parts diammonium phosphate and 42 parts water. The above solution is applied to the base web at an application weight of 158.0 gm/m$^2$ of solution per 85 gm/m$^2$ of base web (web calculated on a dry weight basis). The treated web, on the Yankee, is subjected to a further partial drying operation. The treated base web, after being removed from the Yankee is then subjected to a final drying by drying in a tunnel dryer to 12.5 percent moisture. The finished sheet has a weight in the 200 gm/m$^2$ range and contains approximately 51 percent glycerin. The resulting sheet has a nontacky surface. The sheet can be cut or shredded, as desired, for further processing.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A process for providing a reconstituted tobacco material having an aerosol precursor material incorporated therein, the process comprising the steps of:

(a) providing an extracted tobacco material;

(b) forming the extracted tobacco material into a predetermined shape using a papermaking process, the formed extracted tobacco material having a moisture content of at least about 50 percent by weight; and (c) contacting the formed extracted tobacco material with an aerosol precursor material applied as an aqueous mixture with a ratio of liquid having aqueous character to aerosol precursor material of about 25 to 75 percent by weight while applying heat to the formed extracted tobacco material to permit the aerosol precursor material to penetrate into the formed extracted tobacco material.

2. The process according to claim 1, wherein the formed extracted tobacco material has a moisture content from about 68 to 79 percent by weight.

3. The process according to claim 1, wherein the formed extracted tobacco material has a moisture content form about 68 to 70 percent by weight.

4. The process according to claim 1, wherein the aerosol precursor material comprises glycerin, a liquid having an aqueous character and a phosphate salt soluble in the liquid having the aqueous character.

5. A reconstituted tobacco material provided according to the process of claim 1, having a aerosol precursor material content of greater than about 35 percent by weight.

* * * * *